US005352127A

United States Patent [19]

Muller et al.

[11] Patent Number: 5,352,127

[45] Date of Patent: Oct. 4, 1994

[54] CABLE CONNECTOR AND METHOD

[75] Inventors: John Muller, 1348 Hillside Dr., Tarpon Springs, Fla. 34689; R.J. DiMaggio, Zephyrhills; Randolph C. Hook, Tampa, both of Fla.

[73] Assignees: John Muller; Carmine Muller, both of Tarpon Springs, Fla.

[21] Appl. No.: 21,581

[22] Filed: Feb. 24, 1993

[51] Int. Cl.[5] ..... H01R 29/00

[52] U.S. Cl. ..... 439/188; 200/504

[58] Field of Search ..... 200/504; 439/188

[56] References Cited

U.S. PATENT DOCUMENTS 4,655,159 4/1987 McMills ..... 439/584

FOREIGN PATENT DOCUMENTS 154199 9/1985 European Pat. Off. ..... 439/188

447660 9/1991 European Pat. Off. ..... 439/188

*Primary Examiner*—Gary F. Paumen

*Attorney, Agent, or Firm*—William E. Mouzavires

[57] ABSTRACT

A cable TV connector which will not allow the cable signal to pass unless sufficient torque has been applied to secure the connector to the mating jack. The connector includes two coaxial parts which move together in rotation during initial securement onto the cable jack during which a conductor contact is shorted to one of the parts under the urging of a spring mechanism. A cam and cam follower are provided on the parts such that once sufficient torque has been applied, the parts will move axially relative to each other causing separation of the conductor contact from the surface of one of the parts to break the short and allow the signal to pass.

12 Claims, 3 Drawing Sheets

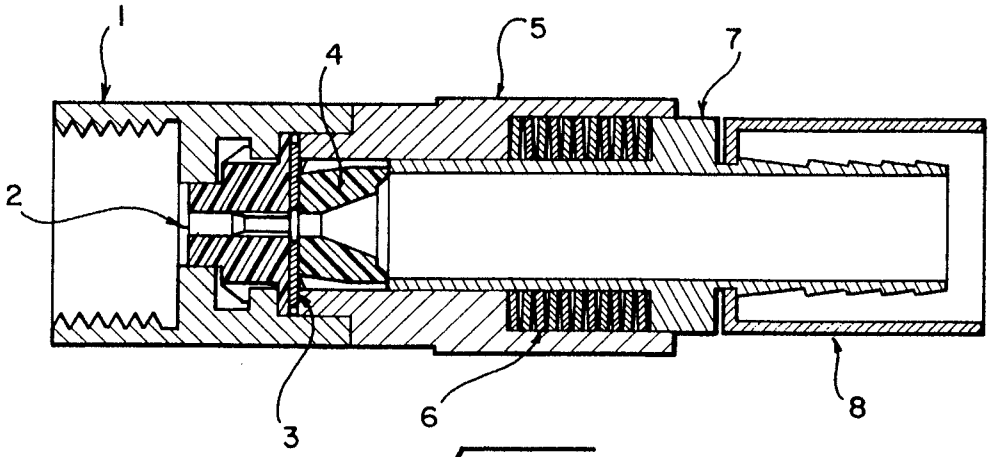
FIG 2-B
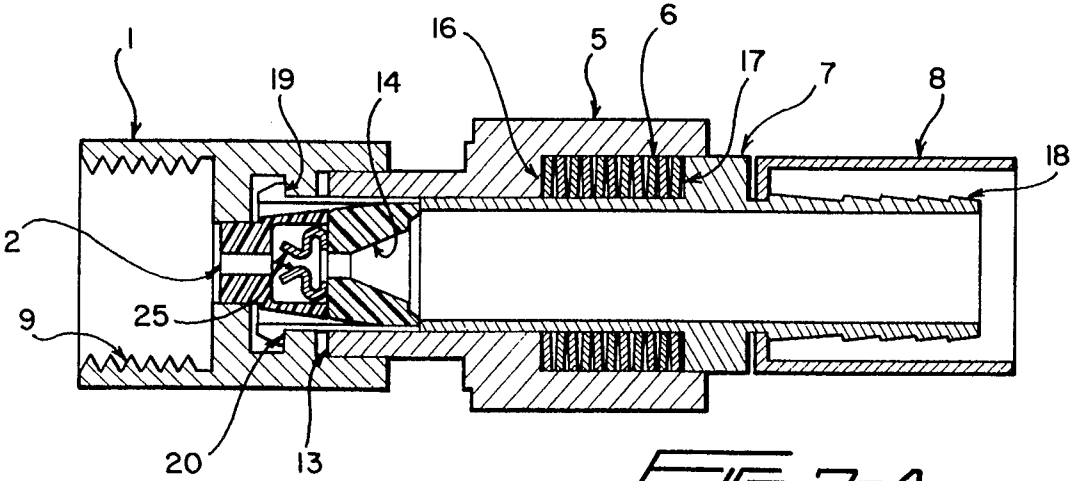
FIG 2-A
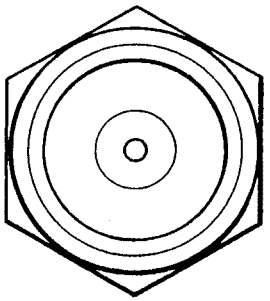
FIG. 2-C

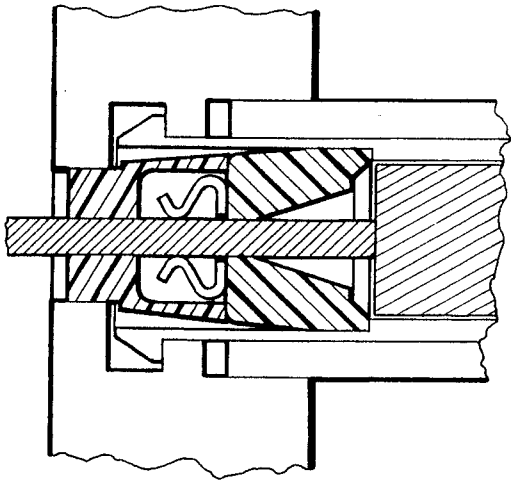
FIG. 4
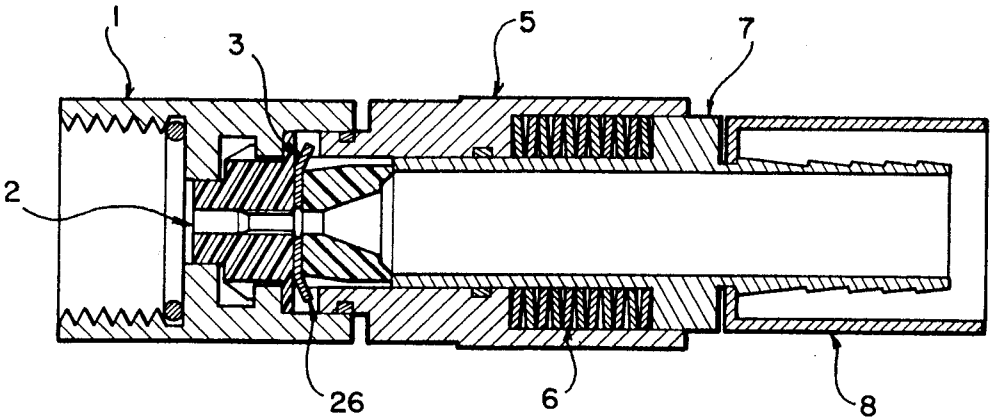
FIG. 3-B
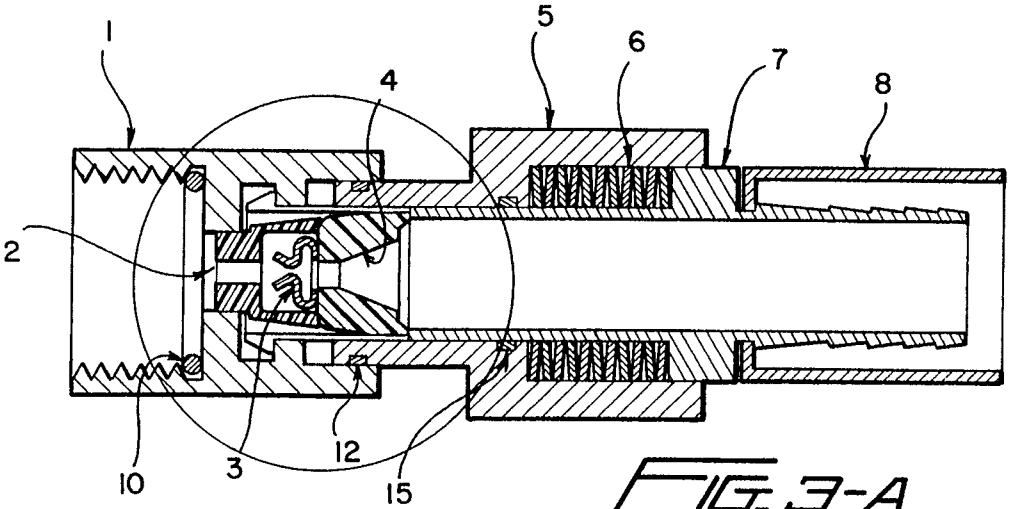
FIG. 3-A

CABLE CONNECTOR AND METHOD

BACKGROUND AND OBJECTS OF THE PRESENT INVENTION

It is well known in the field of electrical connectors, for example, cable television connectors, that if the connector is not sufficiently secured such as by torquing to the cable jack, a loss or leakage of the signal will occur. One attempt of the prior art to deal with the aforementioned problem is disclosed in U.S. Pat. No. 4,655,159 in which a visual sleeve serves to indicate when the connector has been optimally torqued.

One of the objects of the present invention is to provide a novel method for securing a connector in a manner which minimizes, if not prevents, loss of the signal passing through the connector. Included herein is the provision of such a method which clearly indicates or determines whether or not the connector has been sufficiently secured. Further included herein is the provision of such a method which will indicate whether sufficient torque has been applied for securing the connector.

Another object of the present invention is to provide a novel and improved connector for coaxial cable or other equivalent installations which will establish a secure connection to a mating jack, for example, so as to minimize or prevent leakage of the signal passing through the connector. Included herein is the provision of such a connector which will clearly determine or indicate whether it has been sufficiently secured so as to guard against leakage or loss of the signal. Further included herein is the provision of such a connector which will indicate whether sufficient torque has been applied for securing the connector to a jack, for example, so as to minimize the possibility of signal loss arising from an insecure connection.

SUMMARY OF INVENTION

In summary, a preferred embodiment of the present invention provides a connector and a method for securing the same such that, unless sufficient torque has been applied for securing the connector to a mating jack, for example, a conductor contact in the connector will be shorted to the connector body. However, once sufficient torque has been applied, two of the connector parts will be separated to separate the contact from the body part and allow the signal to pass.

A coaxial cable connector in accordance with one preferred embodiment includes an internal spring contact for shorting a cable center conductor until required torque is applied. The connector body includes three main components. First, the thread body which provides a mechanical interface to the mating connector, serves as a cam follower during torquing operation and ultimately serves as a physical indicator of completion of torque operation by confronting a positive stop provided by the cam surface of a nut body. Second, the nut body which provides a hex surface for torque application, a bearing surface for a compression spring stack and the cam surface on which the follower rides. Third, the main body which provides an opposing bearing surface for the compression spring stack and the overall captivation of the connector components.

Electrical shorting is provided by the spring contact which is in electrical connection with the cable center conductor. In the first position, the spring contact fingers rest against the nut body surface to establish a short. Once correct torque is applied, the thread body and the nut body separate against the force of the compression spring stack at which time the electrical connection between the contact fingers and the nut body is broken. Additionally, a crimping ferrule may be provided which is attached directly to the main body. Provisions may also be made which allow the introduction of EMI gaskets if required, and weather seal gaskets for outdoor applications.

DRAWINGS

Other objects and advantages of the present invention will become apparent from the following detailed description taken in conjunction with the attached drawings in which:

FIG. 2A is a longitudinal sectional view of the cable connector assembly illustrated in its self-shorted position;

FIG. 2B is a longitudinal sectional view of the cable connector assembly shown in FIG. 2A but rotated 90 degrees;

FIG. 2C is an end view of the connector assembly;

FIG. 3A is a longitudinal sectional view of the cable connector assembly of FIG. 1 illustrated in unshorted position;

FIG. 3B is a longitudinal sectional view of the cable connector assembly of FIG. 3A but rotated 90 degrees; and FIG. 4 is a sectional detail of a spring contact included in the connector and with coaxial cable installed.

DESCRIPTION OF THE PREFERRED EMBODIMENT

Figure 1:
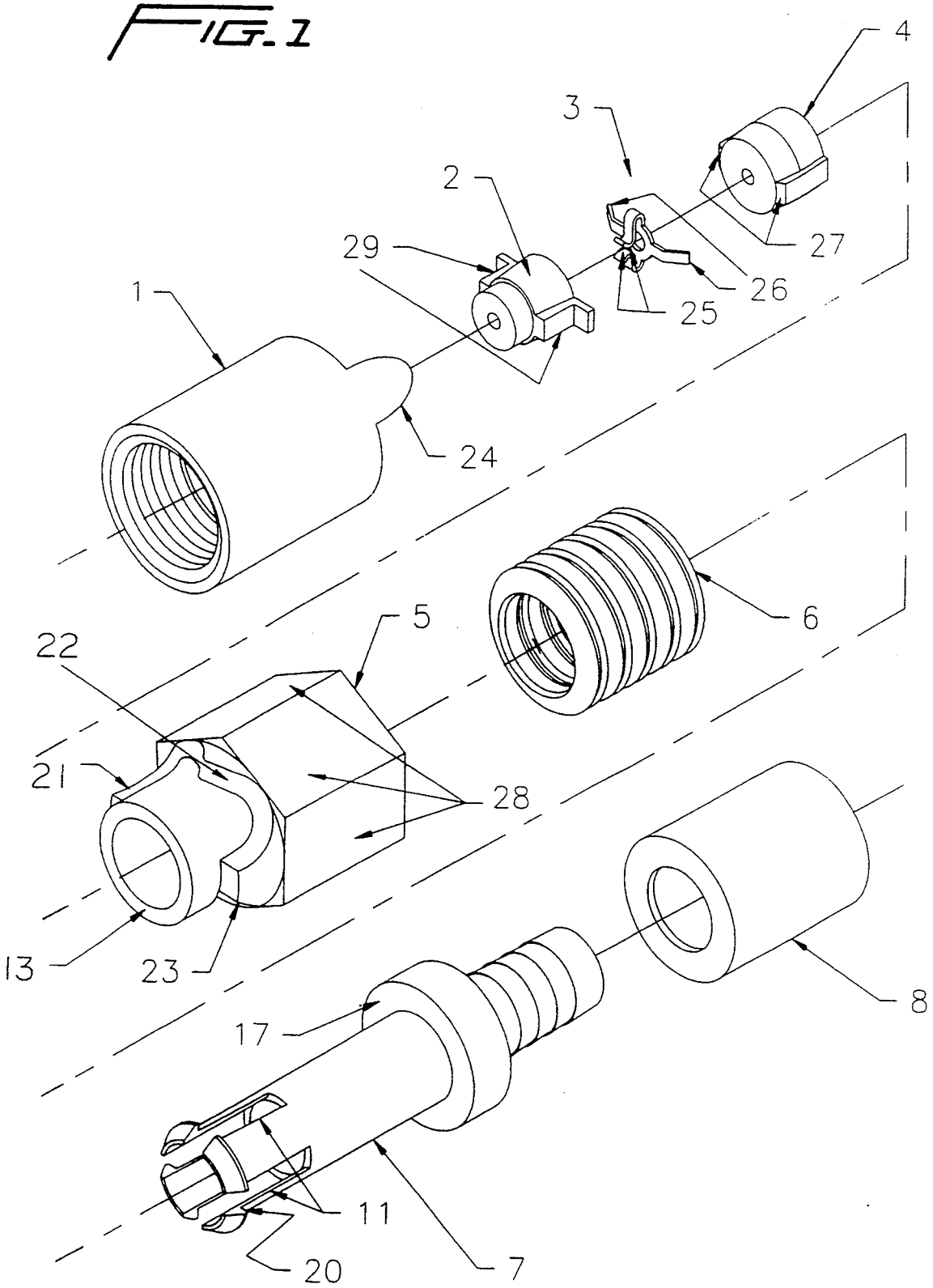
FIG. 1 is an exploded isometric view of a cable connector assembly constituting one preferred embodiment of the present invention.

Referring to FIG. 1 there is illustrated a coaxial cable connector assembly constituting a preferred embodiment of the present invention. The connector includes a thread body 1 with internal threads 9 which accept mating connector external threads of a jack (not shown), for example. The connector further includes a nut body 5 having a sleeve 5*a* of reduced dimension axially received in thread body 1; and a main body 7 which is axially received in the nut body 5 as well as thread body 1 and, in turn, axially receives a conductor contact 3 and insulator guides 2 and 4 as will be further described.

A bearing surface 19 provided in thread body 1 prevents separation of main body 7 and thread body 1 by direct contact with surface 20 of main body 7. Two cam followers 24 are fixed to and symmetrically located at the rear of the thread body 1. In the preferred embodiment the cam followers are an integral part of the thread body 1.

As will be described below followers 24 are engageable with cam surface 22 to cause axial separation of the thread body 1 and nut body 5 during securement of the connector to a jack or other installation.

The nut body 5 includes a hex surface 28 through which a specified torque is applied for securing the connector to the jack. The cam surface 22 is an integral part of the nut body 5 and is designed to produce axial separation between the main body 7 and the nut body 5 as a result of the rotation of the nut body 5 about the longitudinal axis of the main body 7. The cam surface 22 additionally provides two positive stop surfaces 21 and 23, one for each of the two cam followers 24. In the specific form shown, the location of the stop surfaces 21 and 23 is designed to allow a maximum of 90 degrees of rotation of the nut body 5 once specified torque is applied.

Surface 13 of nut body 5 provides contact closure surface for contact fingers 26 of spring contact 3. Internal to the nut body 5, surface 16 provides a thrust surface for a compression mechanism, preferably a spring stack 6. In the specific form shown, the compression spring stack 6 is comprised of belleville type washers. The number of washers in compression spring stack 6 is determined by the axial force necessary to produce the required torque for a given connector application.

The main body 7 includes the opposing thrust surface 17 for compression spring stack 6. Also, main body 7 includes a barbed surface area 18 for better captivation of installed cable shield. Captivation of the cable to the connector is provided by crimp ferrule 8 which when deformed by an appropriate tool, will force the cable shield into barbed surface area 18. Main body surface 20 when located against thread body surface 19 maintains the connector in the assembled condition by resisting separation of thread body 1 from main body 7. The thread body 1 in turn captivates nut body 5 and compression spring stack 6 to unite the complete assembly.

The switch assembly consists of the spring contact 3 and insulated guides 2 and 4. The switch assembly is contained within the main body 7 and is oriented by positioning of protrusions 29 into any opposing two of the four slots 11 in main body 7. Insulated guide 4 provides conical surface 14 which guides the coaxial cable center conductor into the switch assembly. Insulated guide 4 also provides positive stop surfaces 27 which prevent contact fingers 26 from engaging contact surface 13 of nut body 5 when the connector is in the torqued condition as shown in FIG. 3A and FIG. 3B. Insulated guide 2 serves to house spring contact 3 and prevents electrical contact between spring contact fingers 26 and connector components 1, 5 and 7. Spring contact fingers 25 provide continuous electrical contact between spring contact 3 and the coaxial cable center conductor as shown in FIG. 4. Weather and/or EMI seals may be included by incorporation of appropriate gaskets at 10, 12 and 15 in positions shown in FIG. 2A.

In use, when the connector is first connected to a jack, for example, by the threads 9, the contact fingers 26 will be shorted to the nut body 5, 13, see FIG. 2B. During initial securement, the connector parts 1 and 5 will, due to springs 6, rotate together under torquing of nut body 5. However, as the torque is increased by application of a wrench on hex surface 28, the cam followers 24 engaging cam surface 22 will force nut body 5 to move axially away from thread body 1, and when sufficient torque is applied in opposition of course to the bias force of springs 6, the contact fingers 26 will be spaced or disengaged from the nut body 5 (see FIG. 3B) so that it is no longer shorted, thereby allowing the cable signal to pass as desired.

The coaxial cable assembly described here is not necessarily limited to CATV applications and also may be increased or decreased in size according to application requirements. Torque values can be adjusted by modifying the compression spring in number, orientation, material type or type of spring. Indeed, the present invention is not limited to the embodiment disclosed and illustrated but rather the scope of the invention is defined in the appended claims.

In another embodiment (not shown in the drawings) the contact 3, rather than being initially shorted to the connector body, may be switched into contact with the center conductor or another conductor to allow the signal to pass, only upon application of sufficient torque to the body part for securing the assembly. The latter embodiment need not rely on a short circuit but rather utilizes the torque application to the body part to establish or disestablish a circuit through the center conductor allowing the signal to pass only upon sufficient securement of the body parts together.

We claim:

1. A method of securing an electrical connector to a jack or other installation comprising the steps of attaching the connector to the installation with an electrical contact included in the connector short circuited to a conductive portion of the connector, securing the connector to the installation such that when adequate securement is achieved, the contact will no longer be shorted to said conductive portion and will allow a signal to pass to a mating connector, and wherein the connector includes two parts which in one phase of securement move together in rotation as a unit and in a second phase of securement move axially relative to each other such that the contact is no longer shorted to said conductive portion, and wherein the connector is secured to an installation by applying a torque to the connector and wherein once sufficient torque is applied, the contact is no longer shorted to said conductive portion, and wherein there is further included the step of utilizing a cam and cam follower on said parts respectively to cause the parts to move relative to each other upon sufficient torquing of one said part.

2. The method defined in claim 1 including the step of utilizing a spring for biasing the parts to move together as a unit when the parts are rotated during initial securement to the installation.

3. An electrical connector including an electrical contact for passing a signal to an installation to which the connector is to be secured, the connector comprising in combination: first and second parts movable between a first position where the parts lie adjacent to each other and a second position where the parts are spaced from each other, a contact for establishing a circuit for passing a signal to the installation, said contact having a first position for breaking the circuit when the parts are in said first position and having a second position for establishing the circuit when the parts are in said second position, means for moving said parts between said first and second positions thereof during securement of the connector to the installation, and wherein said means includes a cam and a cam follower located on said parts respectively.

4. The connector defined in claim 3 wherein the parts are torqued during securement through threads on one of said parts and once sufficient torque is applied the parts will move to said second positon to establish said circuit.

5. The connector defined in claim 3 including spring means urging the parts to move together as a unit during a phase of securement.

6. The connector defined in claim 5 wherein one of said parts receives the other part and wherein there is further included a third part axially received in both parts, said contact being carried by said third part.

7. The connector defined in claim 6 wherein said third part has a stop portion engageable with said one part and wherein said spring means is located between said third part and said other part.

8. The connector defined in claim 7 wherein said one part has internal threads for securing the connector to an installation.

9. The connector defined in claim 8 wherein said other part has an external surface for engagement by a tool for torquing the connector during securement to an installation.

10. An electrical connector adapted to be secured to an installation to pass an electrical signal to that installation, the connector comprising in combination, first and second parts movable between a first position where the parts lie adjacent to each other and a second position where the parts are spaced from each other, means for establishing a circuit between the connector and the installation when the parts are in said second position, means for short circuiting said circuit when the parts are in said first position, and means including a cam and a cam follower located on said parts respectively for moving said parts between said first and second positions for moving said parts between said first and second positions during securement of the connector to an installation.

11. The connector defined in claim 10 wherein said parts move together during a first phase of securement to an installation while said circuit is short circuited and thereafter the parts move relative to each other into said second position for establishing said circuit.

12. A method of securing an electrical connector to a jack or other installation comprising the steps of attaching the connector to the installation with an electric contact included in the connector short circuited to a conductive portion of the connector, and securing the connector to the installation such that when adequate securement is achieved, the contact will no longer be shorted to said conductive portion and will allow a signal to pass to a mating connector, and wherein the connector includes two parts which in one phase of securement move together as a unit while the contact is shorted to said conductive portion and in a second phase of securement move relative to each other such that the contact is no longer shorted to said conductive portion, and wherein the connector is secured by applying a torque to threads on the connector and wherein once sufficient torque is applied, the contact is no longer shorted to said conductive portion.

* * * * *